US009053699B2

(12) United States Patent
Mittal et al.

(10) Patent No.: US 9,053,699 B2
(45) Date of Patent: Jun. 9, 2015

(54) APPARATUS AND METHOD FOR AUDIO FRAME LOSS RECOVERY

(75) Inventors: Udar Mittal, Hoffman Estates, IL (US); James P. Ashley, Naperville, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 346 days.

(21) Appl. No.: 13/545,277

(22) Filed: Jul. 10, 2012

(65) Prior Publication Data

US 2014/0019142 A1 Jan. 16, 2014

(51) Int. Cl.

| | |
|---|---|
| ***G10L 19/00*** | (2013.01) |
| ***G10L 19/005*** | (2013.01) |
| *G10L 19/20* | (2013.01) |

(52) U.S. Cl.

CPC ..... *G10L 19/005* (2013.01); *G10L 19/20* (2013.01)

(58) Field of Classification Search

USPC ..... 704/500–504

See application file for complete search history.

(56) References Cited

U.S. PATENT DOCUMENTS

| | | | |
|---|---|---|---|
| 8,015,000 | B2 | 9/2011 | Zopf et al. |
| 2003/0009325 | A1 | 1/2003 | Kirchherr et al. |
| 2006/0173675 | A1 | 8/2006 | Ojanpera |
| 2008/0046235 | A1 | 2/2008 | Chen |
| 2011/0007827 | A1 * | 1/2011 | Virette et al. ..... 375/259 |

FOREIGN PATENT DOCUMENTS

| | | | |
|---|---|---|---|
| EP | 0932141 | A2 | 7/1999 |
| EP | 2270776 | A1 | 1/2011 |
| WO | 9950828 | A1 | 10/1999 |
| WO | 2008066265 | A1 | 6/2008 |

OTHER PUBLICATIONS

Patent Cooperation Treaty, International Search Report and Written Opinion of the International Searching Authority for International Application No. PCT/US2013/045763, Dec. 2, 2013, 11 pages.

Combescure, Pierre et al.: "A 16, 24, 32 Kbit/S Wideband Speech Codec Based on ATCELP", Proceedings of IEEE International Conference on Acoustics, Speech, and Signal Processing (ICASSP), vol. I, Phoenix, Arizona, USA, Mar. 1999, all pages.

(Continued)

*Primary Examiner* — Leonard Saint Cyr

(74) *Attorney, Agent, or Firm* — Birch, Stewart, Kolasch & Birch, LLP

(57) ABSTRACT

A method and apparatus provide for audio frame recovery by identifying a sequence of lost frames of coded audio data as being lost or corrupted; identifying a first frame of coded audio data which immediately preceded the sequence of lost frames, as having been encoded using a time domain coding method; identifying a second frame of coded audio data, which immediately followed the sequence of lost frames of coded audio data, as having been encoded using a transform domain coding method; obtaining a pitch delay; generating a second decoded audio portion of the second frame based on the second frame; generating a first decoded audio portion of the second frame based on the pitch delay and decoded audio samples; and generating a decoded audio output of the second frame based on a sequential combination of the first and second decoded audio portions.

9 Claims, 4 Drawing Sheets

(56) References Cited

OTHER PUBLICATIONS

International Telecommunication Union, ITU-T, G.718, Telecommunication Standardization Sector of ITU, Jun. 2008, "Series G.: Transmission Systems and Media, Digital Systems and Networks, Digital terminal equipments—Coding of voice and audio signals", Frame error robust narrow-band and wideband embedded variable bit-rate coding of speech and audio from 8-32 kbit/s, Recommendation ITU-T G.718, all pages.

International Telecommunication Union, ITU-T, G.711, Telecommunication Standardization Sector of ITU, Sep. 1999, "Series G.: Transmission Systems and Media, Digital Systems and Networks, Terminal equipments Coding of analogue signals by pulse code modulation", Pulse code modulation (PCM) of voice frequencies, Appendix I: A high qulaity low-complexity algorithm for packet loss concealment with G.711, ITU-T Recommendation G.711—Appendix I (Previously CCITT Recommendation), all pages.

* cited by examiner

APPARATUS AND METHOD FOR AUDIO FRAME LOSS RECOVERY

FIELD OF THE INVENTION

The present invention relates generally to audio encoding/decoding and more specifically to audio frame loss recovery.

BACKGROUND

In the last twenty years microprocessor speed has increased by several orders of magnitude and Digital Signal Processors (DSPs) have become ubiquitous. As a result, it has become feasible and attractive to transition from analog communication to digital communication. Digital communication offers the advantage of being able to utilize bandwidth more efficiently and allows for error correcting techniques to be used. Thus, by using digital communication, one can send more information through an allocated spectrum space and send the information more reliably. Digital communication can use wireless links (e.g., radio frequency) or physical network media (e.g., fiber optics, copper networks).

Digital communication can be used for transmitting and receiving different types of data, such as audio data (e.g., speech), video data (e.g., still images or moving images) or telemetry. For audio communications, various standards have been developed, and many of those standards rely upon frame based coding in which, for example, high quality audio is encoded and decoded using frames (e.g., 20 millisecond frames). For certain wireless systems, audio coding standards have evolved that use sequentially mixed time domain coding and frequency domain coding. Time domain coding is typically used when the source audio is voice and typically involves the use of CELP (code excited linear prediction) based analysis-by-synthesis coding. Frequency domain coding is typically used for such non-voice sources such as music and is typically based on quantization of MDCT (modified discrete cosine transform) coefficients. Frequency domain coding is also referred to "transform domain coding." During transmission, a mixed time domain and transform domain signal may experience a frame loss. When a device receiving the signal decodes the signal, the device will encounter the portion of the signal having the frame loss, and may request that the transmitter resend the signal. Alternatively, the receiving device may attempt to recover the lost frame. Frame loss recovery techniques typically use information from frames in the signal that occur before and after the lost frame to construct a replacement frame.

BRIEF DESCRIPTION OF THE DRAWINGS

The features of the invention believed to be novel are set forth with particularity in the appended claims. The invention itself however, both as to organization and method of operation, together with objects and advantages thereof, may be best understood by reference to the following detailed description, which describes embodiments of the invention. The description is meant to be taken in conjunction with the accompanying drawings in which:

Figure 1:
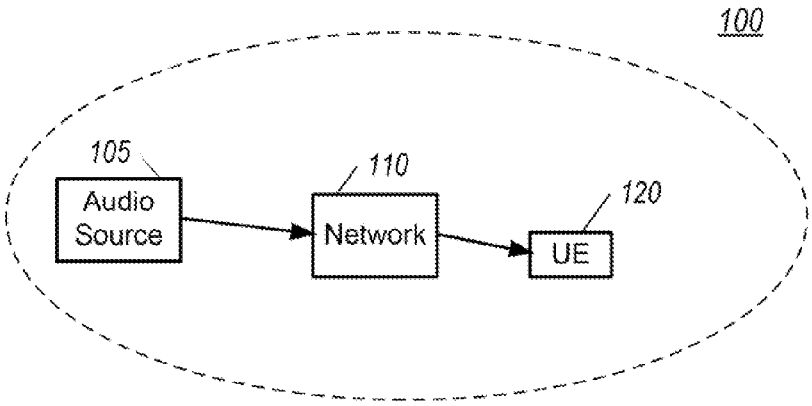
FIG. 1 is a block diagram 100 of a communication system, in accordance with certain embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of the drawings.

Embodiments described herein relate to decoding coded audio signals, which results in a digitized (sampled) version of the source analog audio signal. The signals can be speech or other audio such as music that are converted to digital information and communicated by wire or wirelessly.

Referring to FIG. 1, a diagram of a portion of a communication system 100 is shown, in accordance with certain embodiments. The portion of the communication system 100 includes an audio source 105, a network 110, and a user device (also referred to as user equipment, or UE) 120. The audio source 105 may be one of many types of audio sources, such as another UE, or a music server, or a media player, or a personal recorder, or a wired telephone. The network 110 may be a point to point network or a broadcast network, or a plurality of such networks coupled together. There may be a plurality of audio sources and UE's in the communication system 100. The UE 120 may be a wired or wireless device. In one example, the UE 120 is a wireless communication device (e.g., a cell phone) and the network 110 includes a radio network station to communicate to the UE 120. In another example, the network 110 includes an IP network that is coupled to the UE 120, and the UE 120 comprises a gateway coupled to a wired telephone. The communication system 100 is capable of communicating audio signals between the audio source 105 and the UE 120. While embodiments of the UE 120 described herein are described as being wireless devices, they may alternatively be wired devices using the types of coding protocols described herein. Audio from the audio source 105 is communicated to the UE 120 using an audio signal that may have different forms during its conveyance from the audio source 120 to the UE 120. For example, the audio signal may be an analog signal at the audio source that is converted to a digitally sampled audio signal by the network 110. At the UE 120, the audio signal is received in a form that uses audio compression encoding techniques that are optimized for conveying a sequential mixture of voice and non voice audio in a channel or link that may induce errors. The voice audio can be effectively compressed by using certain time domain coding techniques, while music and other non-voice audio can be effectively compressed by certain transform domain encoding (frequency encoding) techniques. In some systems, CELP (code excited linear prediction) based analysis-by-synthesis coding is the time domain coding technique that is used. The transform domain coding is typically based on quantization of MDCT (modified discrete cosine transform) coefficients. The audio signal received at the UE 120 is a mixed audio signal that uses time domain coding and transform domain coding in a sequential manner. Although the UE 120 is described as a user device for the embodiments described herein, in other embodiments it may be a device not commonly thought of as a user device. For example, it may be an audio device used for presenting audio for a movie in a cinema.

The network 110 and UE 120 may communicate in both directions using a frame based communication protocol, wherein a sequence of frames is used, each frame having a duration and being encoded with compression encoding that is appropriate for the desired audio bandwidth. For example, analog source audio may be digitally sampled 16000 times per second and sequences of the digital samples may be used to generate compression coded frames every 20 milliseconds. The compression encoding (e.g., CELP and/or MDCT) conveys the audio signal in a manner that has an acceptably high quality using far fewer bits than the quantity of bits resulting directly from the digital sampling. It will be appreciated that the frames may include other information such as error mitigation information, a sequence number and other metadata, and the frames may be included within groupings of frames that may include error mitigation, sequence number, and metadata for more than one frame. Such frame groups may be, for example, packets or audio messages. It will be appreciated that in some embodiments, most particularly those systems that include packet transmission techniques, frames may not be received sequentially in the order in which they are transmitted, and in some instances a frame or frames may be lost.

Some embodiments are designed to handle a mixed audio signal that changes between voice and non-voice by providing for changing from time domain coding to transform domain coding and also from transform domain coding to time domain coding. When changing from decoding a time domain portion of the audio signal to decoding a subsequent transform domain portion of the audio signal, the first frame that is transform coded is called the transition frame. As used herein decoding means generating, from the compressed audio encoded within each frame, a set of audio sample values that may be used as an input to a digital to analog converter. If the method that is used for encoding and decoding transform coded frames following the transition frame (otherwise referred to herein as the normal method of encoding and decoding the transform frames) were to be used for encoding and decoding the transition frame without enhancement, a gap (the transition gap) would occur between the last audio sample value generated by the time domain decoding technique and the first audio sample generated by the transform decoding technique. There is an initialization delay in the decoding of a transition frame, which is present because the synthesis memory for the transform domain frame from the previous time domain frame is not available in the current transform domain frame. This results in cessation of output at the start of the transition frame which results in a gap. The gap may be filled by generating what may be termed transition gap filler estimated audio samples and inserting them into the gap of a coded transition frame. One way to generate the transition gap fillers is a forward/backward search method that uses a search process to find two sequential sets (vectors) of audio sample values of equal length; one vector that precedes the transition gap and one vector that succeeds the transition gap; such that when they are combined using a unique gain value for each vector, minimize a distortion value of the combined vector. A length of the two vectors is chosen. It may be equal to or greater than the transition gap. (a value greater than the transition gap provides for overlap smoothing of samples values that are in an overlap region resulting from length of the resulting vector being longer than the transition gap). The values that are varied during the search are the positions of the vectors that are combined (one within the time domain frame preceding the transition frame and one from the transition frame), and the gain used for each vector. This technique results in a coded transition frame that allows a decoder to produce quality audio at the transition frame using a normal transition decoding technique when the transition frame is correctly received. The normal transition decoding technique obtains information from received meta data associated with the transition frame that allows the gains and positions of the vectors used to generate the transition vector to be identified, from which the transition vector can be generated, thereby providing estimated audio sample values for the transition gap.

Figure 2:
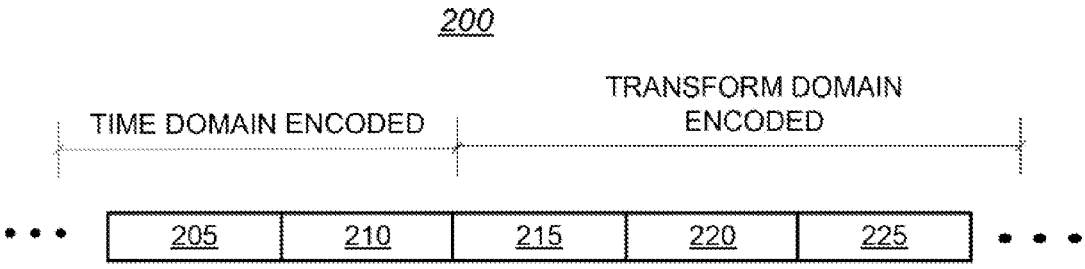
FIG. 2 is a timing diagram 200 of a frame coded audio signal used in the communication system, in accordance with certain embodiments.

Referring to FIG. 2, a timing diagram 200 shows a portion of a coded audio signal 200 comprising a sequence of audio frames that is being received by a device such as UE 120. Five of the frames in the sequence are identified in the timing diagram 200. Two frames of time domain coded audio, frames 205, 210, are followed by three frames of transform domain coded audio, frames 215, 220, 225. The transition frame is frame 215. The type of encoding used for each frame may be identified to the receiving device by metadata that is sent within or outside of the frame structure of the received frames, but in the examples described herein, the identification is within each of the received frames. When operating in an environment in which individual frames are occasionally not recoverable by the receiving device (which can occur in both wired and wireless systems due to a variety of channel disturbances), it is desirable to be able to construct an approximation of a lost frame (alternatively described as performing a lost frame recovery) that provides acceptable audio performance rather than request retransmission, because of the typically long time delay needed to request and receive a retransmission of the lost frame. In some embodiments, a sequence of two or more frames may be lost. For convenience of the descriptions given herein, the term "sequence" as used to describe lost frames includes the case of only one lost frame. Embodiments described herein below provide for audio recovery in the case when the transition frame is lost or unusable due to corruption (uncorrectable errors). For conciseness, the term "lost frame" will be used for both the case when a frame is either not received or incorrectly received.

Figure 5:
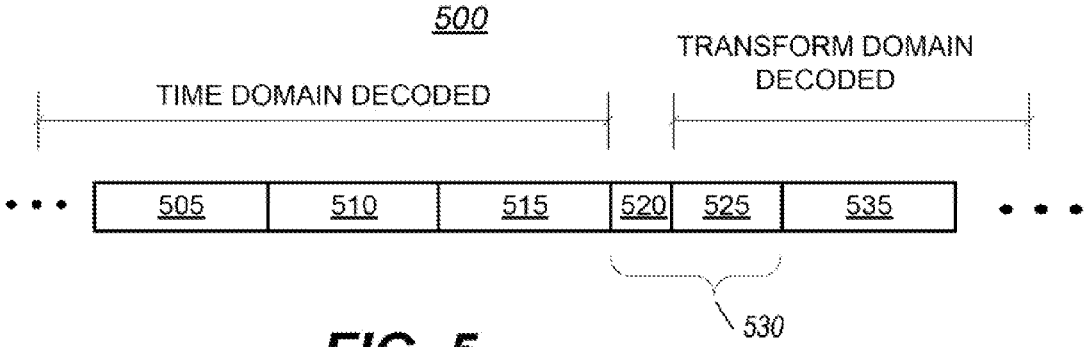
FIG. 5 shows a timing diagram 500 of a decoded frame coded audio signal being processed by a device in the communication system of FIG. 1, in accordance with certain embodiments.
Figure 3:
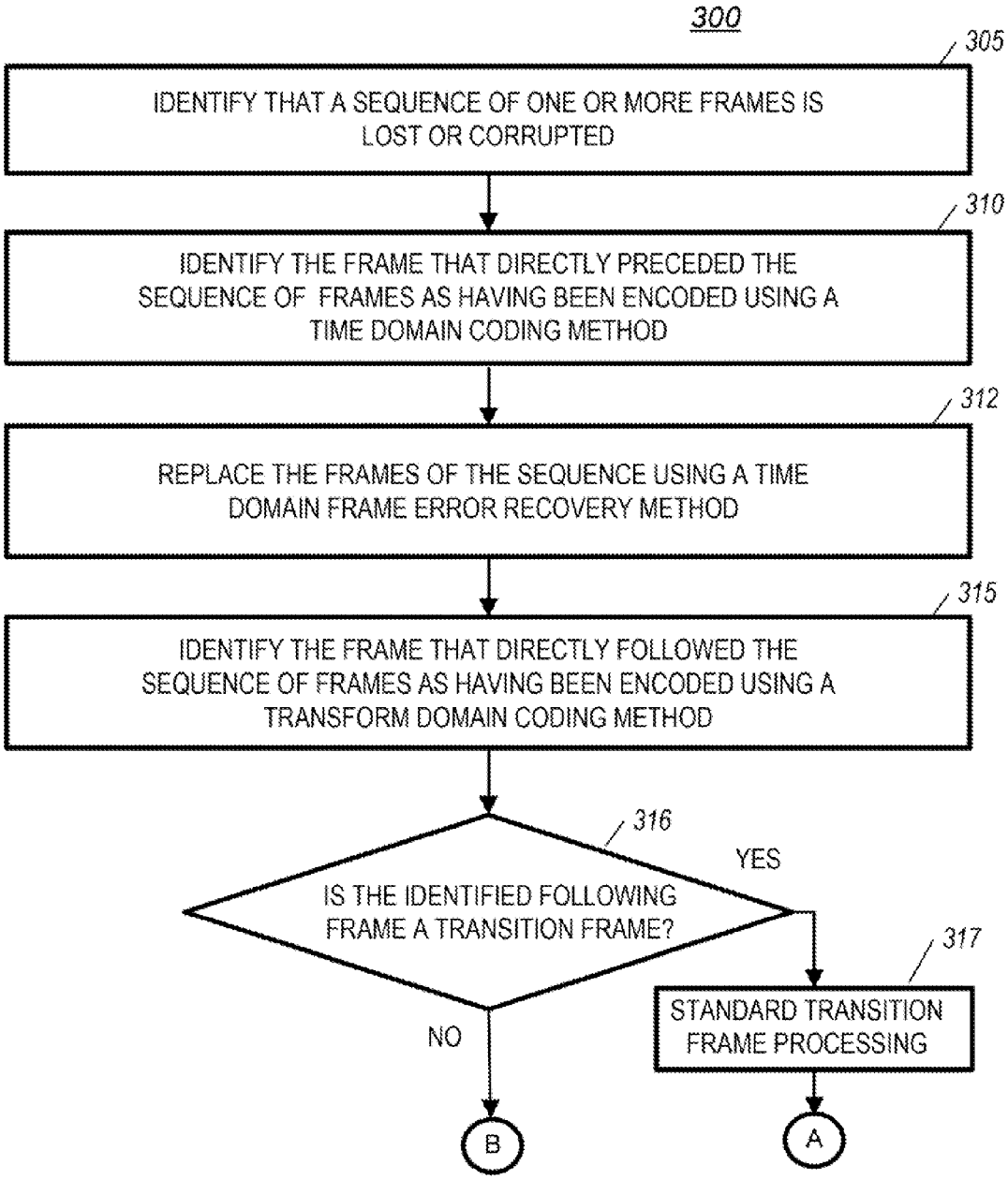
FIGS. 3 and 4 show a flow chart 300 of some steps of a method for audio frame loss recover used by a device operating in the communication system of FIG. 1, in accordance with certain embodiments.
Figure 4:
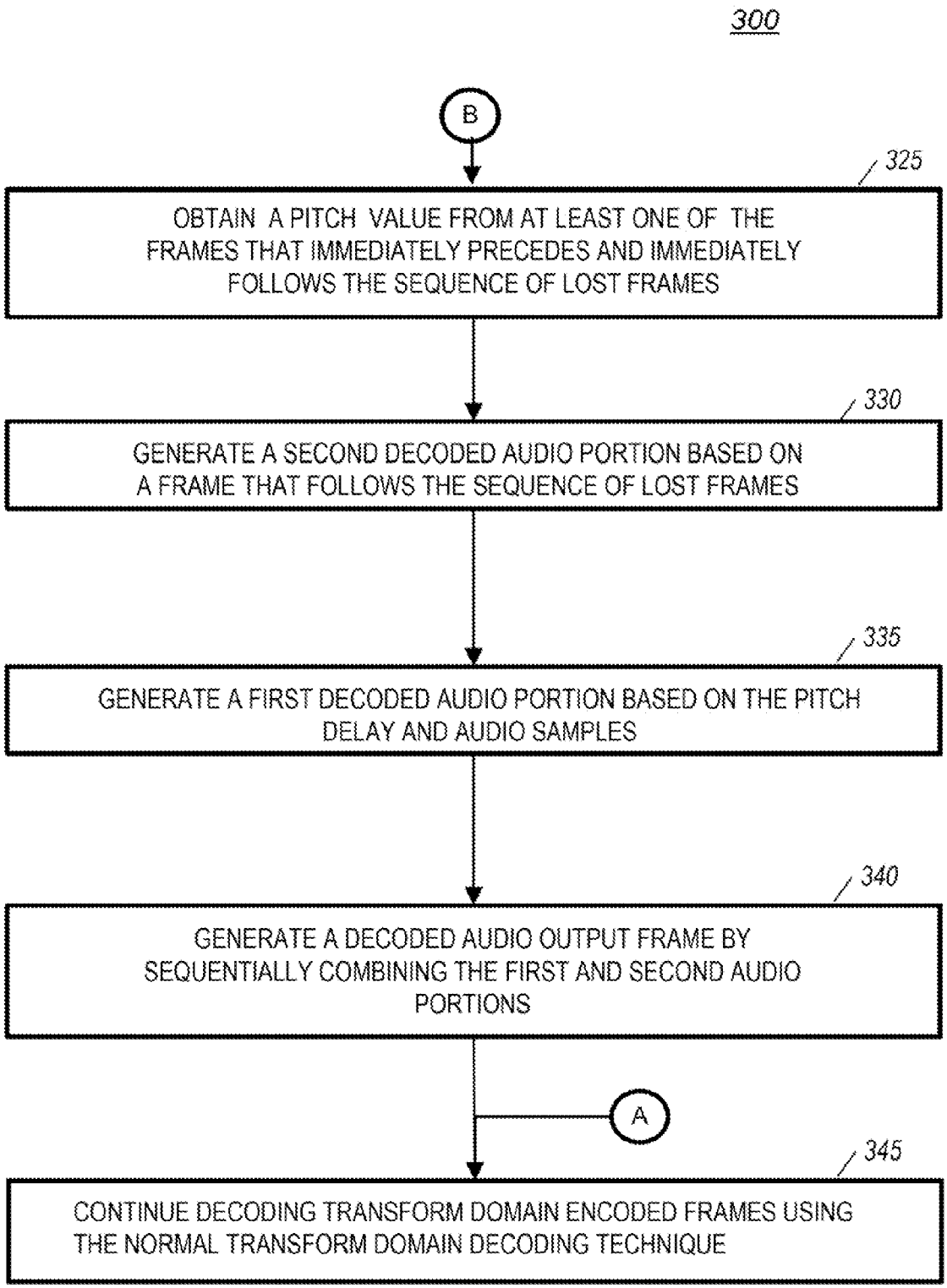

Referring to FIGS. 3, 4, and 5, a flow chart 300 in FIGS. 3 and 4 shows some steps of a method to perform audio frame loss recovery in the situation in which a transition frame for transitioning from a time domain decoding to a transform domain decoding is unrecoverable in a mixed audio signal. FIG. 5 shows a timing diagram of the decoded audio frames that result from the method. Decoded audio frames 505, 510 (FIG. 5) are generated using the time domain decoding method used for the time domain coded portion of the mixed audio signal preceding the transition frame 215 of FIG. 2, with coded frames 205 and 210 (FIG. 2) used as inputs, respectively, to generate decoded frames 505, 510. At step 305 (FIG. 3), a sequence of one or more lost frames of coded audio (e.g., frame 505 in FIG. 5 or e.g., frames 505 and 510 in FIG. 5) is identified as being lost or corrupted. This may be accomplished by determined that the sequence numbers in received frames do not include the sequence numbers of the lost frames. At step 310 (FIG. 3), the frame of coded audio 210 (FIG. 2) that immediately precedes the sequence of lost frames (in an example of one lost frame, frame 215 in FIG. 2) is identified as having been encoded using a time domain coding method. At step 312 (FIG. 3), the lost frames in the sequence are replaced using known techniques for replacing audio samples of lost time domain coded frames. In the example of two lost frames, the lost frames are frames 210, 215 (FIG. 2), and the audio samples for the lost frames are replaced by using known techniques for replacing lost time domain frames, resulting in frames 510, 515 (FIG. 5). At step 315 (FIG. 3), the frame of coded audio 220 (FIG. 2) that immediately follows the sequence of lost frames is identified as having been encoded using a transform domain coding method (i.e., not using time domain nor transition frame encoding). The last frame 220 (FIG. 2) in the sequence of lost frames may be any one of the last time domain frame preceding a transition frame or the transition frame or a transform domain coded frame. A determination may be made at step 316 (FIG. 3) as to whether the frame following the sequence of lost frames is a transition frame. When it is determined to be a transition frame, the method continues at step 317 (FIG. 3), wherein the normal transition decoding technique is used, and finishes at step 345 (FIG. 4) by continuing the decoding of transform domain frames using the normal transform domain decoding technique.

Otherwise, at step 325 (FIG. 4), a pitch delay is obtained from a selected frame or frames that precede or follow the sequence of replacement frames. The pitch delay is the period expressed as a quantity of audio samples that represents the fundamental frequency of voice audio within a frame or frames. At an 8 Khz sampling rate, typical pitch delays are in the range of 16-160 samples. The name pitch delay arises from a mathematical model of voice that includes a filter having delay characteristics determined by the pitch delay. In some embodiments a frame is selected that immediately precedes or immediately follows the sequence of lost frames (in the example of one lost frame, these are, respectively, coded frames 210, 220 of FIG. 2. In some embodiments the pitch delay is typically received as a parameter with each of the time domain frames, and in some embodiments, with certain of the transform domain frames. In the embodiments in which the pitch delay is received with the time domain frames, the time domain frame immediately preceding the sequence of lost frames is selected from which to obtain the pitch delay. In the example of a sequence of frames that has only one lost frame (frame 215 of FIG. 2), this is encoded frame 210 (FIG. 2), which becomes decoded frame 510 (FIG. 5).

At step 330 (FIG. 4), a second decoded audio portion 525 (FIG. 5) of the decoded audio output frame 530 (FIG. 5) is generated as a set of sample values based on the frame 220 (FIG. 2), using normal transform domain decoding techniques for decoding the frame 220 (FIG. 2). As noted above, using the normal transform domain decoding techniques for decoding a first transform frame in a sequence of time domain coded frames following by transform domain coded frames results in audio sample values only for a portion of the first transform domain decoded frame, which is this case is the second portion of decoded audio output frame 530 (FIG. 5), leaving a transition audio gap at the beginning of the decoded frame. At step 335 (FIG. 4), a first decoded audio portion 520 (FIG. 5) of an output audio frame 530 (FIG. 5) is generated based on the pitch delay. The first decoded audio portion 520 (FIG. 5) comprises a set of estimated audio samples, $\hat{s}_g$, and may also be described as a transition gap filler 520 (FIG. 5). As described in more detail below (in an example with reference to Equation (1)), the pitch delay may be used to select from where audio sample values are obtained within certain decoded audio frames to form the first decoded audio portion 520 (FIG. 5) of decoded audio output frame 530 (FIG. 5). At step 340 (FIG. 4), the decoded audio output frame 530 (FIG. 5) (also referred herein to as a new transition frame) is generated by combining the first audio portion 520 (FIG. 5) sequentially with the second decoded audio portion 525 (FIG. 5). The sequential combination of the first audio portion 520 (FIG. 5) and the second audio portion 525 (FIG. 5) is performed by inserting the first audio portion 520 (FIG. 5) at the beginning of the decoded output audio frame 530 (FIG. 5), followed by the second audio portion 525 (FIG. 5). The method ends at step 345 (FIG. 4) by continuing the decoding of transform domain frames using the normal transform domain decoding technique As described in more detail below, the first and second portions 520, 525 (FIG. 5) of the decoded output audio frame 530 (FIG. 5) may comprise audio sample values that overlap in time and for which overlap smoothing techniques are applied during the sequential combination.

Figure 6:
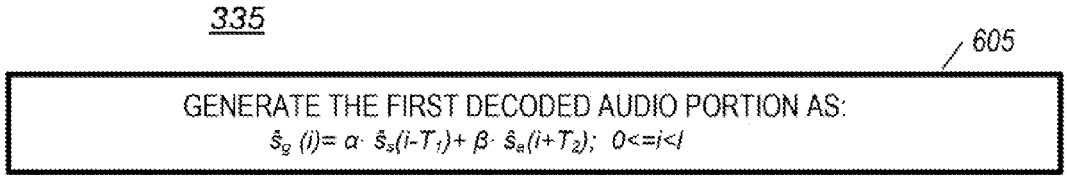
FIGS. 6-8 are flow charts 605, 705, 805, each showing a step of the method 300 described with reference to FIGS. 3 and 4, in accordance with certain embodiments.

The transition gap filler described in step 335 (FIG. 4) may be determined using a forward/backward gap filling method, which is shown as step 605 of FIG. 6 and is expressed as follows when the sequence of lost frames comprises only one frame (e.g., frame 220 of FIG. 2):

$$\hat{s}_g(i)=\alpha\cdot\hat{s}_s(i-T_1)+\beta\cdot\hat{s}_a(i+T_2);\ 0\leq i<l \tag{1}$$

Figure 7:
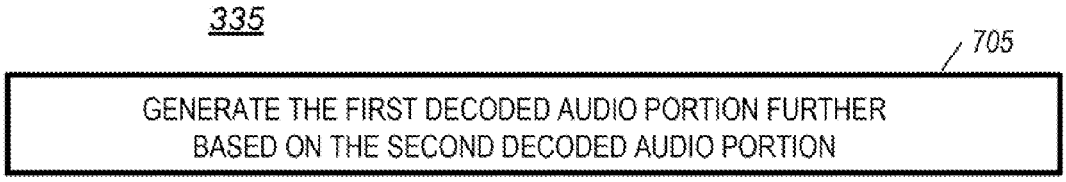
Figure 8:
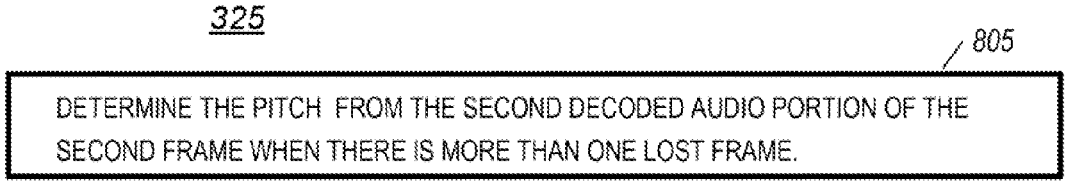

$\hat{s}_s(0)$ is the last sample value of a selected decoded time domain frame from which the transition gap filler audio sample values; $\hat{s}_g(i)$, $0<i<l$, are partially derived. $\hat{s}_a(0)$ is the first sample value of a selected decoded transform frame from which the transition gap filler audio sample values; $\hat{s}_g(i)$, $0<i<l$, are partially derived. In some embodiments the selected decoded time domain frame is the last replacement frame of the sequence of lost frames (e.g., frame 515 of FIG. 5), or in some cases, from the frame preceding the last replacement frame. Audio samples may be used from the frame preceding the last replacement frame, for example, when the pitch delay exceeds the frame length. In some embodiments, the selected decoded transform domain frame is the decoded transform frame (e.g., frame 530 of FIG. 5) that is following immediately after the sequence of lost frames. In this instance, it will be appreciated that the first decoded audio portion determined at step 335 (FIG. 4) is determined from the second decoded audio portion 530 (FIG. 5) determined at step 330 (FIG. 4), which is shown as step 705 of FIG. 7. The value l is the length of the transition gap filler. The value i is a decoded audio sample index. Equation (1) relies upon the sample rates of both the time domain frames and transform domain frames being equivalent. Index changes may be made to the above formula in embodiments when the sample rates are different. $T_1$ is a quantity of samples whose total duration approximates the pitch delay T. The pitch delay T is determined from a correctly received frame (see step 325 of FIG. 4) and is used as a backward offset ($-T_1$) into the selected decoded time domain frame. In some embodiments the pitch delay may be determined from the decoded time domain frame immediately preceding the last lost frame (in this example, frame 510 of FIG. 5) or a transform domain frame (e.g., 530 of FIG. 5). As shown in step 805 of FIG. 8, the pitch delay may be obtained from the decoded output frame 530 (FIG. 5) in step 325 of FIG. 4 when there are a predetermined minimum number of lost frames, such as two. The value $T_2$ is used as a forward offset into the selected decoded transform domain frame. In some embodiments $T_2$ is a quantity of sample durations that approximates a minimum integral multiple of the pitch delay that prevents attempted usage of decoded sample values that would be in the transition gap (and therefore cannot be determined from the decoded transform domain coded frame 220 (FIG. 2) immediately following the lost frame). In some embodiments, the decoded time domain frame that is selected to be used for deriving the first portion of the transition gap filler bits is a replacement time domain frame other than the one immediately preceding the last lost frame. For example, when the pitch delay exceeds one frame length, audio samples may taken from the frame preceding the last replacement frame. A set of samples of length l is used from the selected decoded time domain frame, wherein the position of the selected set of samples is determined in manner to properly align the offsets of the first and second portions.

The gains $\alpha$ and $\beta$ are either each preset equal to 0.5, or in some embodiments one of the gains is preset at a value $\alpha$ that is other than 0.5 and $\beta$ is preset to $1-\alpha$. The choice of gains may be based on the particular types of time domain and transform domain coding used and other parameters related to the time domain and transform portions of the audio, such as the type of the audio in each portion. For example, if the time domain frame is unvoiced or silent frame then $\alpha$ and $\beta$ are preset to 0.0 and 1.0, respectively. In another embodiment the transition gap filler can be divided into 2 parts of length l/2 each and in first part $\alpha_1>\beta_1$, and in the second part $\beta_2>\alpha_2$, which can be expressed as:

$$\hat{s}_{g1}(i)=\alpha_1\cdot\hat{s}_s(i-T_1)+\beta_1\cdot\hat{s}_a(i+T_2);\ 0\le i<l/2 \tag{2a}$$

$$\hat{s}_{g2}(i)=\alpha_2\cdot\hat{s}_s(i-T_1)+\beta_2\cdot\hat{s}_a(i+T_2);\ l/2\le i<l \tag{2b}$$

In some embodiments the transition gap filler is generated to be longer than the transition gap (i.e., l is longer than the transition gap caused by decoding a first transform domain coded frame) in order provide smooth merging with wither the last frame of the sequence of replacement frames (at the leading edge of the longer gap filler vector) or the portion of the decoded transform domain frame that follows the transition gap (at the trailing edge of the longer gap filler vector), or both. In one example of providing this smooth merging, the values of the overlapping samples at an edge are each modified by a different set of multiplying factors, each set having a factor for each sample, wherein in one set the factors increase with an index value and in the other set the factors decrease with the index value, and for which the sum of the two factors for every index value is one, and for which the index spans the overlap at the edge.

Embodiments described herein provide a method of generating a new decoded time-domain-to-transform-domain transition audio frame when a coded transition frame is lost, without knowing the parameters of the lost transition frame. The decoder does not know that the lost frame was a transition frame and hence the lost frame is reconstructed using a time domain frame error reconstruction method. The next good frame, which is a transform domain frame, becomes a new transition frame for the decoder. The method is resource efficient and the new transition frame provides good audio quality.

Figure 9:
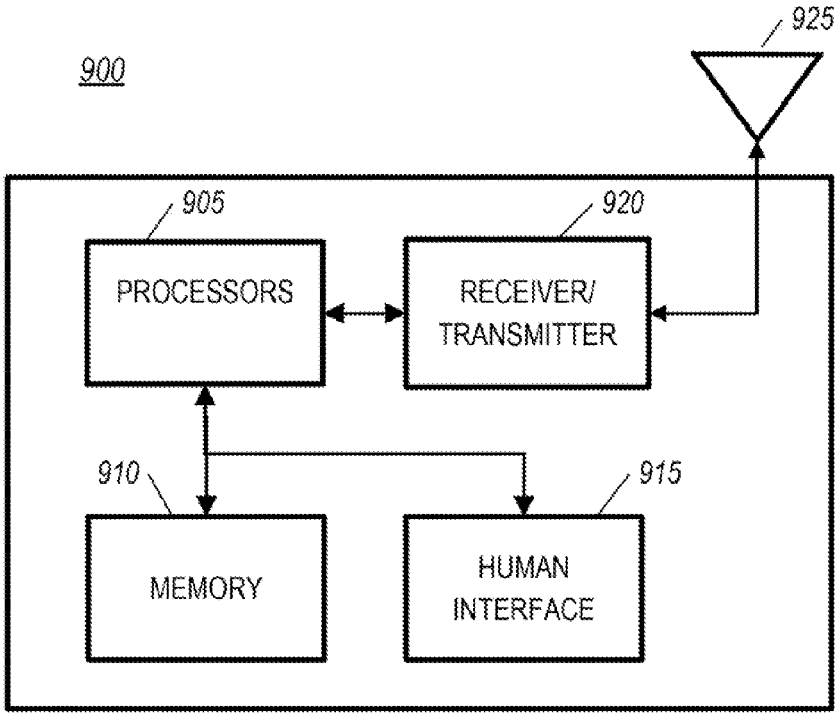
FIG. 9 is a block diagram 900 of a device used in the communication system 100 described with reference to FIG. 1, in accordance with certain embodiments.

FIG. 9 is a block diagram of a device 900 that includes a receiver/transmitter, in accordance with certain embodiments, and represents a user device such as UE 120 or other device that processes audio frames such as those described with reference to FIG. 2 after they are sent over a channel or link, in accordance with techniques described with reference to FIGS. 1-7. The device 900 includes one or more processors 905, each of which may include such sub-functions as central processing units, cache memory, instruction decoders, just to name a few. The processors execute program instructions which could be located within the processors in the form of programmable read only memory, or may located in a memory 910 to which the processors 905 are bi-directionally coupled. The program instructions that are executed include instructions for performing the methods described with reference to flow charts 300, 600 and 700. The processors 905 may include input/output interface circuitry and may be coupled to human interface circuitry 915. The processors 905 are further coupled to at least a receive function, although in many embodiments, the processors 905 are coupled to a receive-transmit function 920 that in wireless embodiments is coupled to a radio antenna 925. In wired embodiments, the receive-transmit function 920 is a wired receive-transmit function and the antenna is replaced by one or more wired couplings. In some embodiments the receive/transmit function 920 itself comprises one or more processors and memory, and may also comprise circuits that are unique to input-output functionality. The device 900 may be a personal communication device such as a cell phone, a tablet, or a personal computer, or may be any other type of receiving device operating in a digital audio network. In some embodiments, the device 900 is an LTE (Long Term Evolution) UE (user equipment that operates in a 3GPP ($3^{rd}$ Generation Partnership Project) network.

It should be apparent to those of ordinary skill in the art that for the methods described herein other steps may be added or existing steps may be removed, modified or rearranged without departing from the scope of the methods. Also, the methods are described with respect to the apparatuses described herein by way of example and not limitation, and the methods may be used in other systems.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

The processes illustrated in this document, for example (but not limited to) the method steps described in FIGS. 3, 4, 6, and 7, may be performed using programmed instructions contained on a computer readable medium which may be read by processor of a CPU. A computer readable medium may be any tangible medium capable of storing instructions to be performed by a microprocessor. The medium may be one of or include one or more of a CD disc, DVD disc, magnetic or optical disc, tape, and silicon based removable or non-removable memory. The programming instructions may also be carried in the form of packetized or non-packetized wireline or wireless transmission signals.

It will be appreciated that some embodiments may comprise one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the methods and/or apparatuses described herein. Alternatively, some, most, or all of these functions could be implemented by a state machine that has no stored program instructions, or in one or more application specific integrated circuits (ASICs), in which each function or some combinations of certain of the functions are implemented as custom logic. Of course, a combination of the approaches could be used.

Further, it is expected that one of ordinary skill, notwithstanding possibly significant effort and many design choices motivated by, for example, available time, current technology, and economic considerations, when guided by the concepts and principles disclosed herein will be readily capable of generating such stored program instructions and ICs with minimal experimentation.

In the foregoing specification, specific embodiments of the present invention have been described. However, one of ordinary skill in the art appreciates that various modifications and changes can be made without departing from the scope of the present invention as set forth in the claims below. As examples, in some embodiments some method steps may be performed in different order than that described, and the functions described within functional blocks may be arranged differently (e.g.,). As another example, any specific organizational and access techniques known to those of ordinary skill in the art may be used for tables. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. A method for processing a sequence of frames of coded audio data comprising the steps of:

identifying a sequence of lost frames of coded audio data as being lost or corrupted, wherein the sequence of lost frames comprises one or more lost frames;

identifying a first frame of coded audio data, which immediately preceded the sequence of lost frames of coded audio data, as having been encoded using a time domain coding method;

identifying a second frame of coded audio data, which immediately followed the sequence of lost frames of coded audio data, as having been encoded using a transform domain coding method;

generating replacement audio samples for the sequence of lost frames based on the first frame of coded data;

obtaining a pitch delay from at least one of the first and second frames of coded audio data;

generating a second decoded audio portion of the second frame based on the second frame of coded audio data;

generating a first decoded audio portion of the second frame based on the pitch delay and at least one of the second decoded audio portion and the replacement audio samples; and generating a decoded audio output of the second frame based on a sequential combination of the first and second decoded audio portions, wherein the first decoded audio portion is determined as $$\hat{s}_g(i)=\alpha\cdot\hat{s}_s(i-T_1)+\beta\cdot\hat{s}_g(i+T_2);\ 0<+i+l,$$

wherein $\hat{s}_g$ is a vector of length l determined as a weighted sum of decoded audio samples, wherein a first set of samples $\hat{s}_s(i-T_1)$ is weighted by the value $0<=\alpha<=1$ and a second set of samples $\hat{s}_\alpha(i+T_2)$ is weighted by the value $\beta=1-\alpha$, $T_1$ is the pitch delay, $T_2$ is an integer multiple of the pitch delay.

2. The method of claim 1 further comprising:

generating a sequence of replacement audio output frames for the sequence of lost frames of coded audio data based at least on the first frame of coded data.

3. The method of claim 1 wherein the audio samples used in the determination of the first decoded audio portion comprise audio samples from a last replacement frame of the sequence of lost frames and the second decoded audio portion.

4. An apparatus for decoding an audio signal, comprising:

a receiver for receiving a sequence of frames of coded audio data; and a processing system for identifying a sequence of lost frames of coded audio data as being lost or corrupted, wherein the sequence of lost frames comprises one or more lost frames, identifying a first frame of coded audio data, which immediately preceded the sequence of lost frames of coded audio data, as having been encoded using a time domain coding method, identifying a second frame of coded audio data, which immediately followed the sequence of lost frames of coded audio data, as having been encoded using a transform domain coding method, generating replacement audio samples for the sequence of lost frames based on the first frame of coded data;

obtaining a pitch delay from at least one of the first and second frames of coded audio data, generating a second decoded audio portion of the second frame based on the second frame of coded audio data, generating a first decoded audio portion of the second frame based on the pitch delay and at least one of the second decoded audio portion and the replacement audio samples, and generating a decoded audio output of the second frame based on a sequential combination of the first and second decoded audio portions, wherein the processor determines the first decoded audio portion as $$\hat{s}_g(i)=\alpha\cdot\hat{s}_s(i-T_1)+\beta\cdot\hat{s}_\alpha(i+T_2);\ 0<+i+l,$$

wherein $\hat{s}_g$ is a vector of length l determined as a weighted sum of decoded audio samples, wherein a first set of samples $\hat{s}_s(i-T_1)$ is weighted by the value $0<=\alpha<=1$ and a second set of samples $\hat{s}_\alpha(i+T_2)$ is weighted by the value $\beta=1-\alpha$, $T_1$ is the pitch delay, $T_2$ is an integer multiple of the pitch delay.

5. The apparatus according to claim 4, wherein the processor is further for:

generating a sequence of replacement audio output frames for the sequence of lost frames of coded audio data based at least on the first frame of coded data.

6. The apparatus according to claim 4, wherein the audio samples used in the determination of the first decoded audio portion comprise audio samples from a last replacement frame of the sequence of lost frames and the second decoded audio portion.

7. A non-transitory computer readable medium that stores programming instructions that, when executed on a processor having hardware associated therewith for receiving an audio signal, performs processing of a sequence of frames of coded audio data, comprising:

identifying a sequence of lost frames of coded audio data as being lost or corrupted, wherein the sequence of lost frames comprises one or more lost frames;

identifying a first frame of coded audio data, which immediately preceded the sequence of lost frames of coded audio data, as having been encoded using a time domain coding method;

identifying a second frame of coded audio data, which immediately followed the sequence of lost frames of coded audio data, as having been encoded using a transform domain coding method;

generating replacement audio samples for the sequence of lost frames based on the first frame of coded data;

obtaining a pitch delay from at least one of the first and second frames of coded audio data;

generating a second decoded audio portion of the second frame based on the second frame of coded audio data;

generating a first decoded audio portion of the second frame based on the pitch delay and at least one of the decoded audio portion and the replacement audio samples; and generating a decoded audio output of the second frame based on a sequential combination of the first and second decoded audio portions, wherein the first decoded audio portion is determined as $$\hat{s}_g(i)=\alpha\cdot\hat{s}s(i-T_1)+\beta\cdot\hat{s}_\alpha(i+T_2);\ 0<+i+l,$$

wherein $\hat{s}_g$ is a vector of length l determined as a weighted sum of decoded audio samples, wherein a first set of samples $\hat{s}_s(i-T_1)$ is weighted by the value $0<=\alpha<=1$ and a second set of samples $\hat{s}_\alpha(i+T_2)$ is weighted by the value $\beta=1-\alpha$, $T_1$ is the pitch delay, $T_2$ is an integer multiple of the pitch delay.

8. The non-transitory computer readable medium according to claim 7, wherein the instructions further perform:

generating a sequence of replacement audio output frames for the sequence of lost frames of coded audio data based at least on the first frame of coded data.

9. The non-transitory computer readable medium according to claim 7, wherein the audio samples used in the determination of the first decoded audio portion comprise audio samples from a last replacement frame of the sequence of lost frames and the second decoded audio portion.

* * * * *